US007264213B2

(12) United States Patent
Liu

(10) Patent No.: US 7,264,213 B2
(45) Date of Patent: Sep. 4, 2007

(54) HANGING DEVICE FOR TOOL

(76) Inventor: Yung Yuan Liu, No. 9, Lane 1397, Guangsing Rd., Taiping City, Taichung County (TW) 411

( * ) Notice: Subject to any disclaimer, the term of this patent is extended or adjusted under 35 U.S.C. 154(b) by 204 days.

(21) Appl. No.: 11/201,995

(22) Filed: Aug. 11, 2005

(65) Prior Publication Data

US 2007/0034771 A1 Feb. 15, 2007

(51) Int. Cl.
*A47F 5/00* (2006.01)

(52) U.S. Cl. ..... 248/309.1; 248/314; 248/909; 211/70.6; 206/378

(58) Field of Classification Search ..... 211/70.6; 248/317, 682, 686, 909, 289.11; 206/346, 206/377, 378, 1.5, 806; 403/164, 165, 300, 403/301, 326, 329, 361, DIG. 14
See application file for complete search history.

(56) References Cited

U.S. PATENT DOCUMENTS 5,467,874 A * 11/1995 Whitaker ..... 206/378
5,740,911 A * 4/1998 Chou ..... 206/378
6,581,894 B1 * 6/2003 Tong ..... 248/314
6,854,594 B2 * 2/2005 Vasudeva et al. ..... 206/1.5
6,854,607 B2 * 2/2005 Tong ..... 211/70.6
7,121,031 B2 * 10/2006 Wheeler ..... 40/673
2002/0130235 A1 * 9/2002 Tong ..... 248/291.1
2005/0126943 A1 * 6/2005 Liu ..... 206/378
2005/0230587 A1 * 10/2005 Yang ..... 248/314

* cited by examiner

*Primary Examiner*—Ramon O. Ramirez
*Assistant Examiner*—Bradley Duckworth
(74) *Attorney, Agent, or Firm*—Banger Shia

(57) ABSTRACT

There is disclosed a hanging device including a hanger, a stationary connector, a rotational connector, and a tool-connecting element. The rotational connector is connected to a first portion of the tool-connecting element. A tool can be connected to an opposite second portion of the tool-connecting element. When the second portion is separated from the first portion of the tool-connecting element, the second portion and the tool can be rotated relative to the rotational connector. Thus, the tool can be removed from the second portion of the tool-connecting element.

3 Claims, 7 Drawing Sheets

HANGING DEVICE FOR TOOL

BACKGROUND OF INVENTION

1. Field of Invention

The present invention relates to a hanging device and, more particularly, a hanging device for hanging an extension rod or socket for display or storage.

2. Related Prior Art

An extension rod or socket may be covered by means of a plastic shell on a side and covered by means of a piece of cardboard on an opposite side. Alternatively, an extension rod or socket may be put in a box.

The foregoing manners of packing an extension rod or socket both require a large space. Moreover, a customer cannot inspect the size of an extension rod or socket. To overcome these drawbacks, there have been provided various hangers for hanging extension rods or sockets in predetermined positions.

Hanging an extension rod or socket on a hanger, it requires only a small space for display or storage. However, as an extension rod or socket cannot be rotated relative to a hanger, a customer has to take the hanger as well as the extension rod or socket from a hook or nail in order to inspect the size of the extension rod or socket. This is inconvenient.

The present invention is therefore intended to obviate or at least alleviate the problems encountered in prior art.

SUMMARY OF INVENTION

An objective of the present invention is to provide a hanging device for hanging a tool so that the size of the tool can easily be inspected.

Another objective of the present invention is to provide a hanging device consisting of a hanger, a stationary connector, a rotational connector, and a tool-connecting element so that the hanger can be used for hanging tools one after another.

According to the present invention, a hanging device includes a hanger, a stationary connector, a rotational connector, and a tool-connecting element. The stationary connector is formed at an end of the hanger and with hooks. The rotational connector includes an annular groove in the internal side for receiving the hooks so that the rotational connector can be rotated relative to the stationary connector and that the rotational connector cannot be removed from the stationary connector, blocks on the external side, a key formed at an end, and two hooks extended from the key. The tool-connecting element includes a head and a joint. The head includes a leftover portion formed with a stop on the internal side for engagement with the hooks, a dispensable portion, and ribs formed between the leftover portion and the dispensable portion. The joint includes two resilient tabs between and against which the key is put. Each of the resilient tabs includes a boss inserted in two bosses defined in the internal side of the tool before the key is put between and against the resilient tabs. The ribs can be cut in order to separate the dispensable portion from the leftover portion so that the tool can be removed from the joint.

Other objectives, advantages and novel features of the invention will become more apparent from the following detailed description in conjunction with the drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
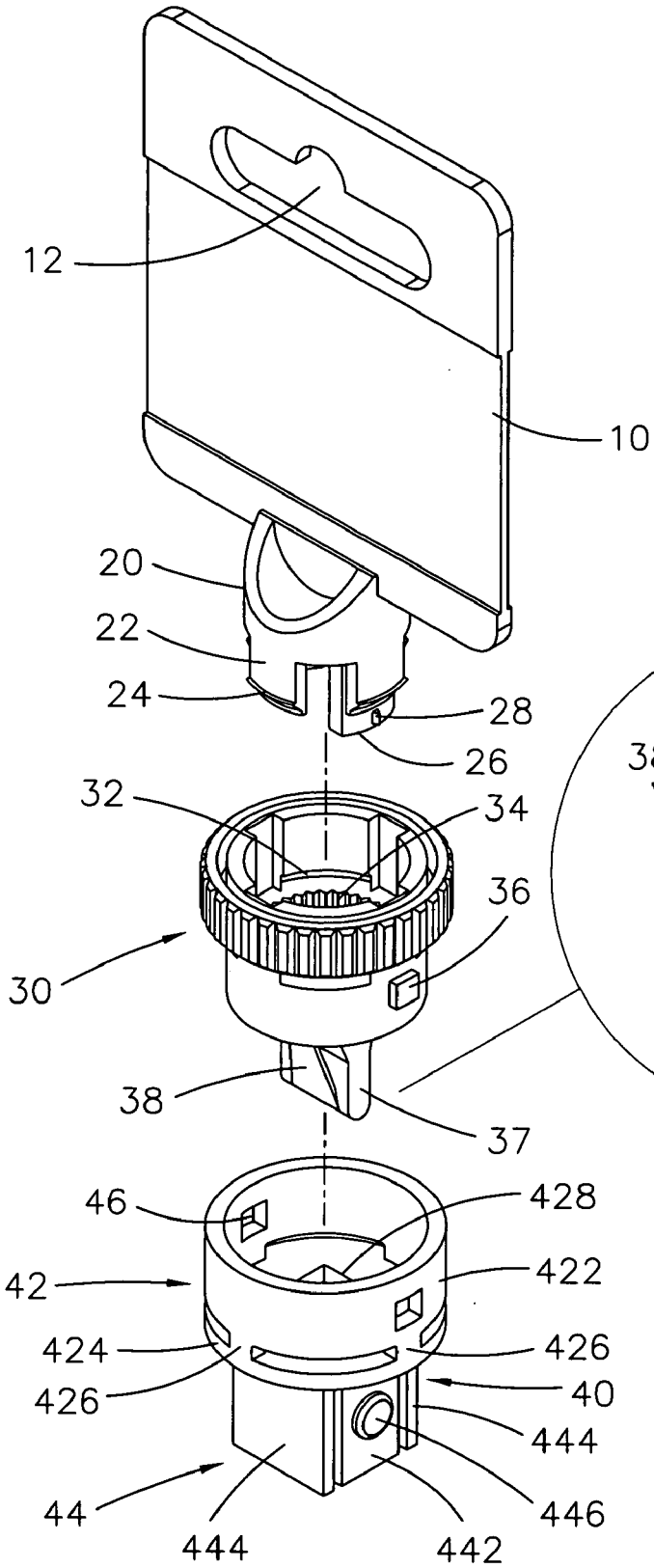
FIG. 1 is an exploded view of a hanging device according to the preferred embodiment of the present invention.

Referring to FIG. 1, there is shown a hanging device according to the preferred embodiment of the present invention. The hanging device includes a hanger 10, a stationary connector 20, a rotational connector 30, and a tool-connecting element 40.

The hanger 10 is substantially a flat element with a slot 12 defined therein near an upper edge so that it can be hung on a hook or nail or any other proper object. The stationary connector 20 is formed on a lower edge of the hanger 10. The stationary connector 20 includes an external cylinder 22 and an internal cylinder 26. A plurality of hooks 24 is extended from the external cylinder 22. At least one tooth 28 is formed on the internal cylinder 26.

Figure 2:
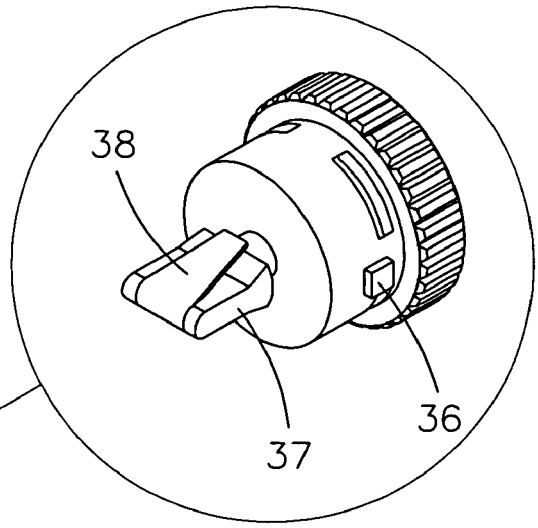
FIG. 2 is a perspective view of a rotational element of the hanging device shown in FIG. 1.

Referring to FIGS. 1 and 2, the rotational connector 30 includes a large cylindrical section and a small cylindrical section with a diameter smaller than that of the large cylindrical section. An annular groove 32 is defined in the internal side of the large cylindrical section. A plurality of teeth 34 is formed on the internal side of the small cylindrical section. A plurality of blocks 36 is formed on the external side of the small cylindrical section. A key 37 is extended from the bottom of the small cylindrical section. The key 37 is made with a thickness and a width much larger than the thickness. Two hooks 38 are extended from two opposite sides of the key 37.

Figure 3:
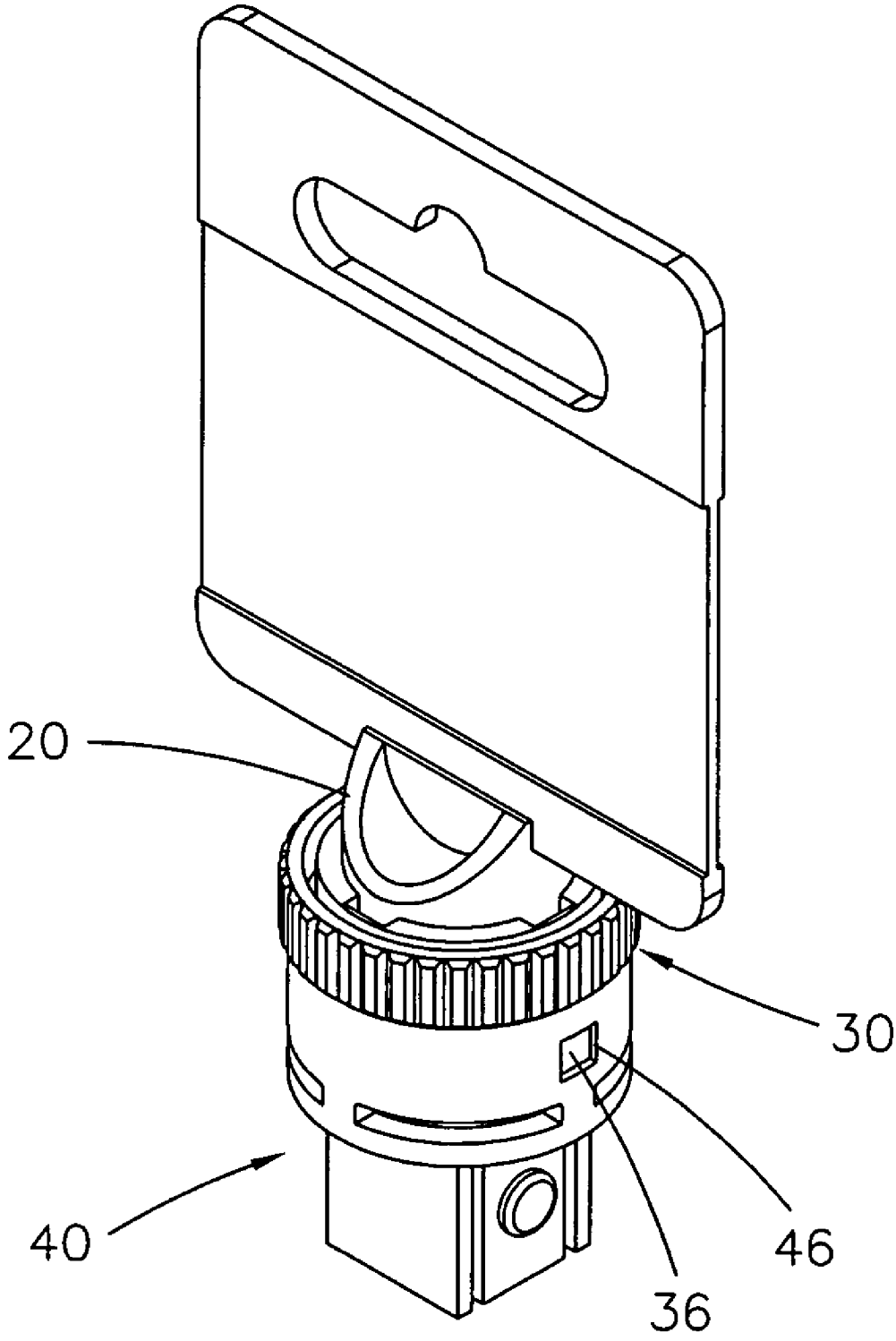
FIG. 3 is a perspective view of the hanging device shown in FIG. 1.
Figure 4:
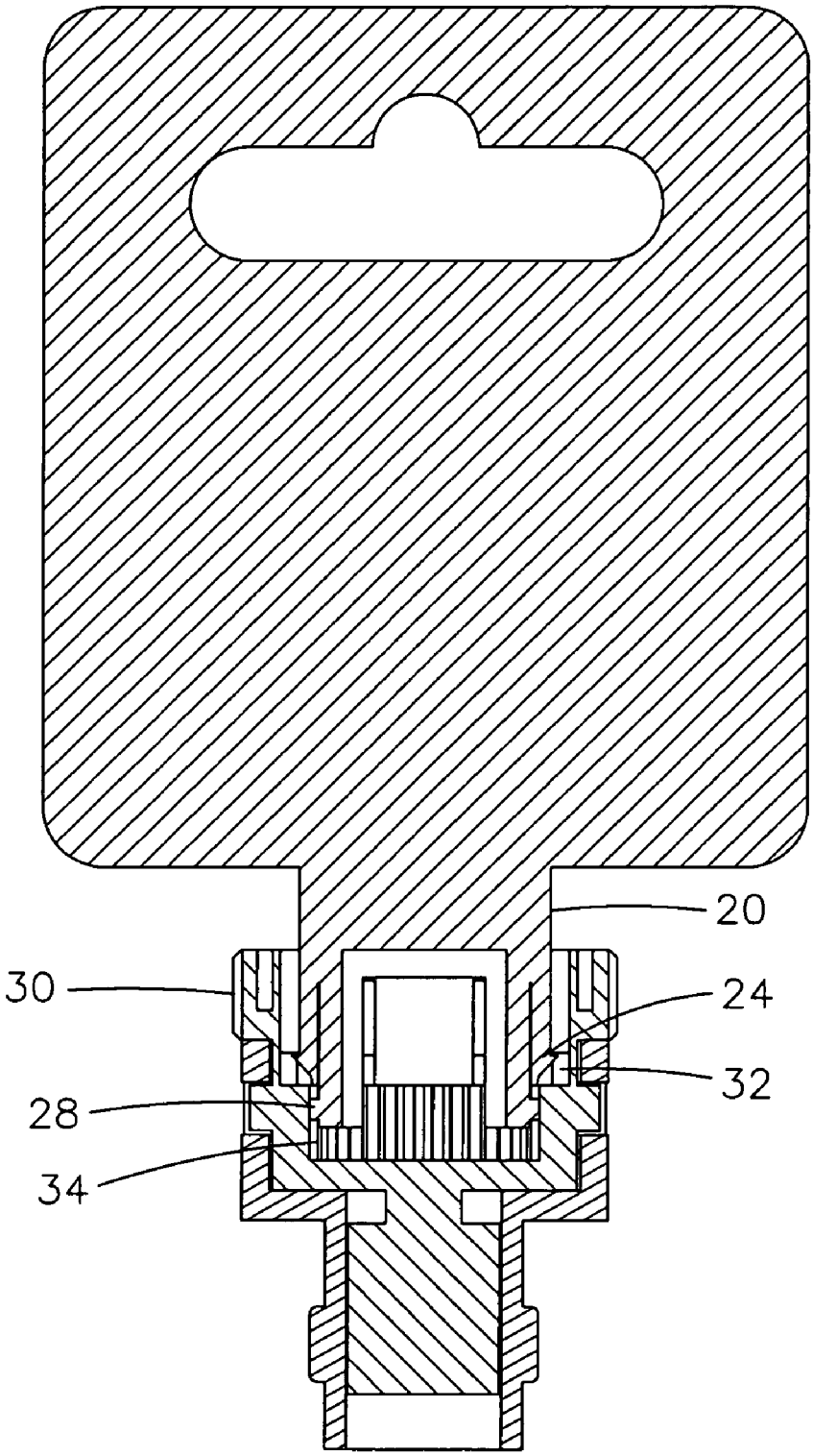
FIG. 4 is a cross-sectional view of the hanging device shown in FIG. 3.

Referring to FIGS. 3 and 4, the rotational connector 30 is connected to the stationary connector 20. The hooks 24 are put in the annular groove 32. The tooth 28 is engaged with the teeth 34. Therefore, the rotational connector 30 can be rotated relative to the stationary connector 20; however, they cannot be removed from each other.

The tool-connecting element 40 includes a head 42 and a joint 44 extended from the head 42. The head 42 includes a leftover portion 422 and a dispensable portion 424 connected to the leftover portion 422 by means of a plurality of ribs 426. A stop 428 is formed on the internal side of the leftover portion 422. A plurality of apertures 46 is defined in the leftover portion 422.

The joint 44 includes two opposite resilient tabs 442 and two opposite resilient tabs 444. A boss 446 is formed on each of the resilient tabs 442.

Figure 5:
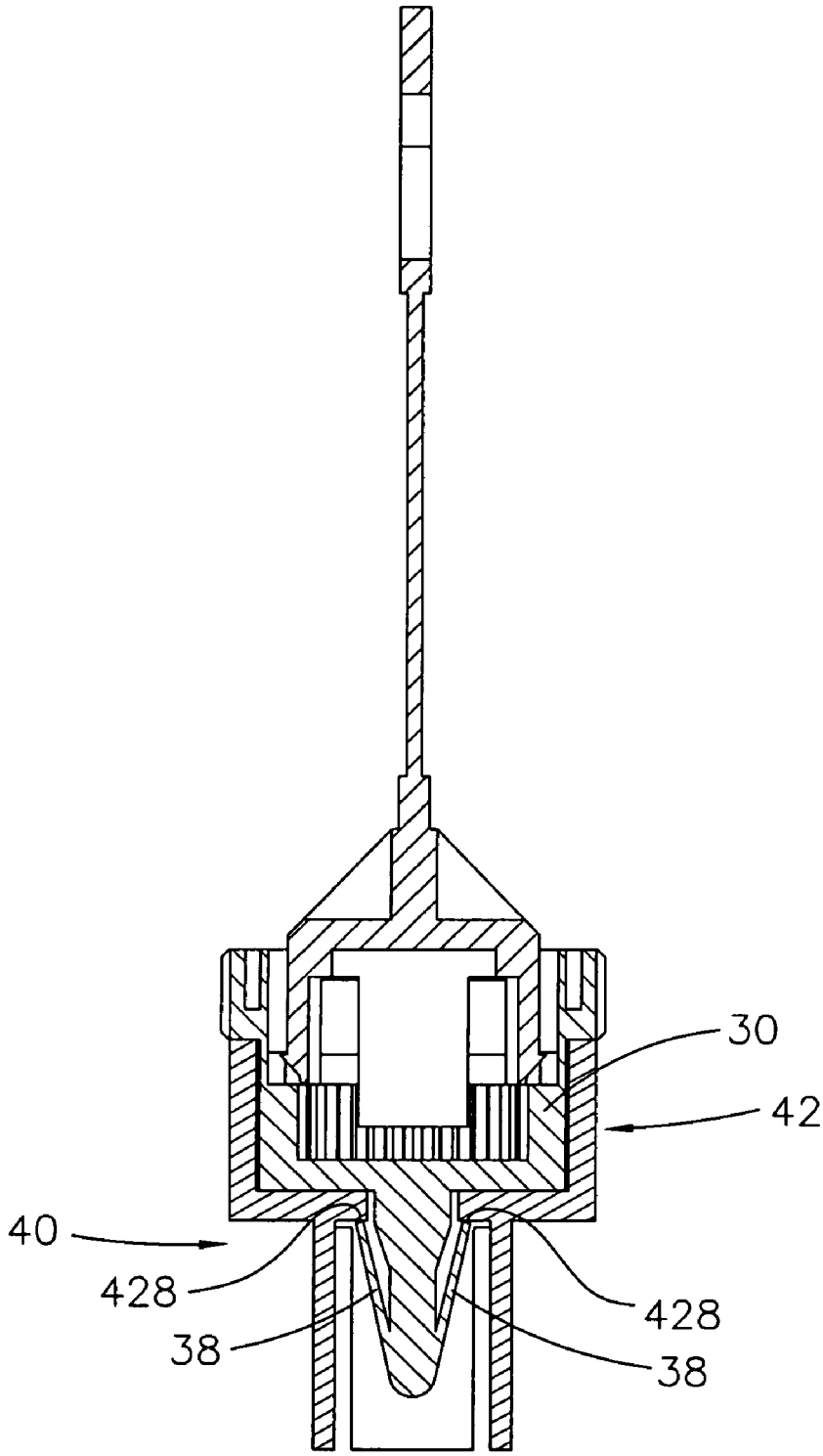
FIG. 5 is another cross-sectional view of the hanging device shown in FIG. 3.

Referring to FIGS. 3 and 5, the head 42 of the tool-connecting element 40 is connected to the rotational connector 30. The blocks 36 are put in the apertures 46. The hooks 38 hook the stop 428.

Figure 7:
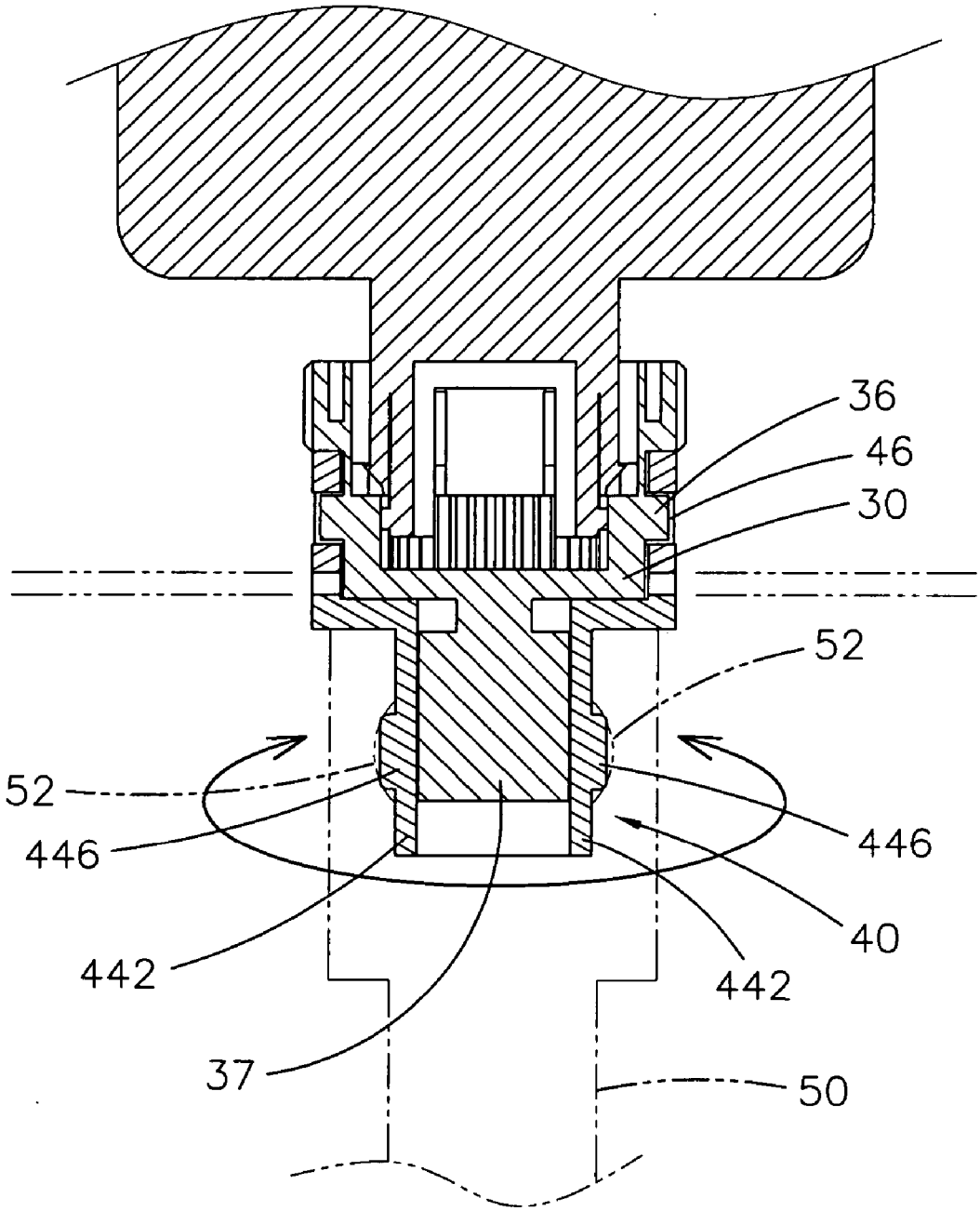
FIG. 7 is a cross-sectional view of the hanging device shown in FIG. 6.

Referring to FIG. 7, an end of a tool 50 is connected to an end of the tool-connecting element 40, the bosses 446 are put in two recesses 52 defined in the internal side of the tool 50. The width of the key 37 is marginally larger than the distance between the resilient tabs 442 so that the bosses 446 are kept in the recesses 52. Thus, the tool 50 is kept to the tool-connecting element 40. Moreover, the tool 50 cannot be rotated relative to the tool-connecting element 40. As the apertures 46 receive the blocks 36, the rotation of the tool-connecting element 40 relative to the rotational connect 30 is avoided, and they are bound to rotate together.

As discussed above, the tool 50 can be hung by means of the hanger. The tool 50 can easily be rotated so that its size can easily be inspected.

Figure 6:
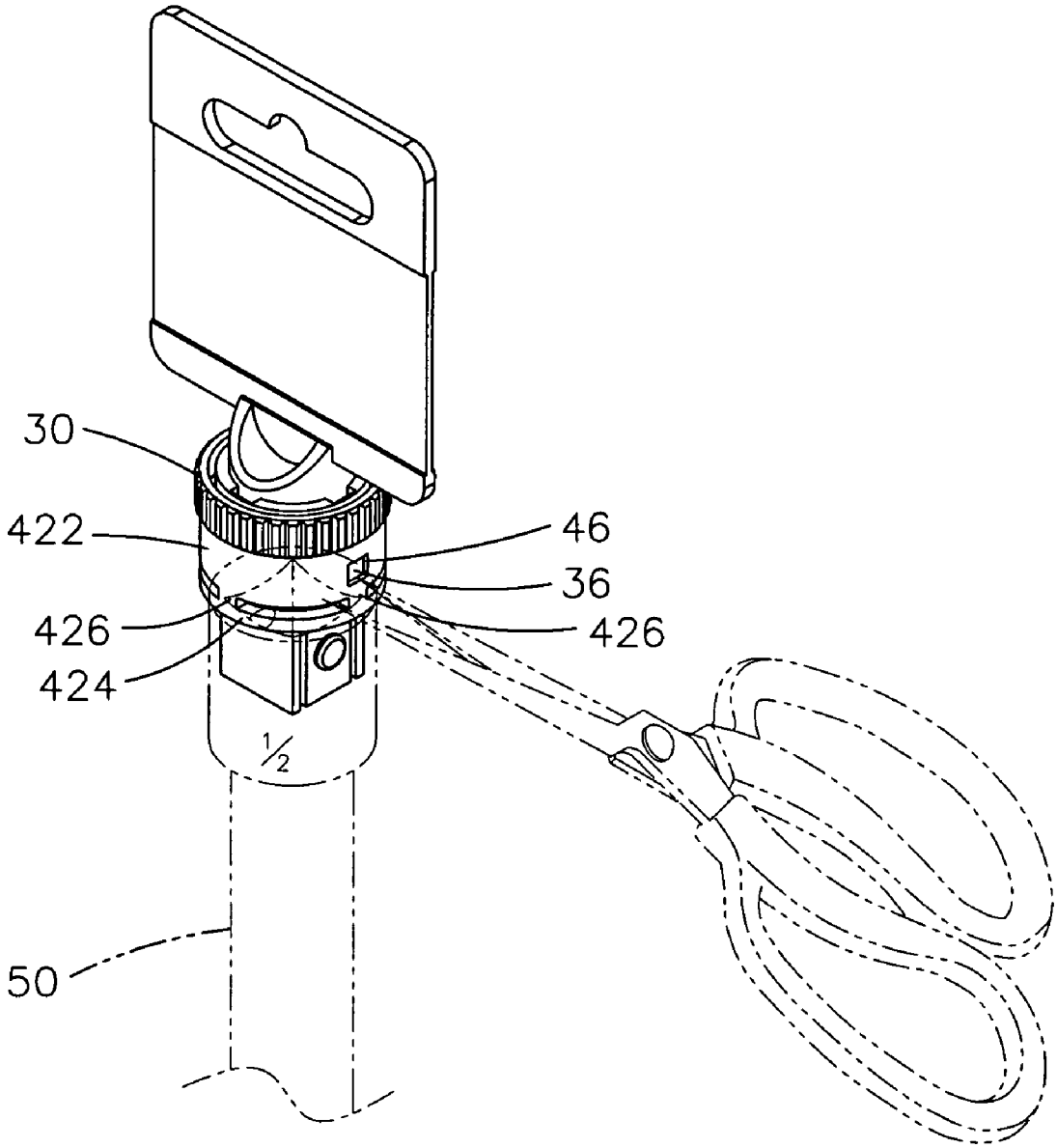
FIG. 6 is a perspective view of the hanging device shown in FIG. 3 to be cut by means of a pair of scissors.

Referring to FIG. 6, wishing to use the tool 50, a person may cut the ribs 426. The dispensable portion 424 is removed from the leftover portion 422. The leftover portion 422 is kept to the rotational connector 30 because the apertures 46 still receive the blocks 36.

Figure 8:
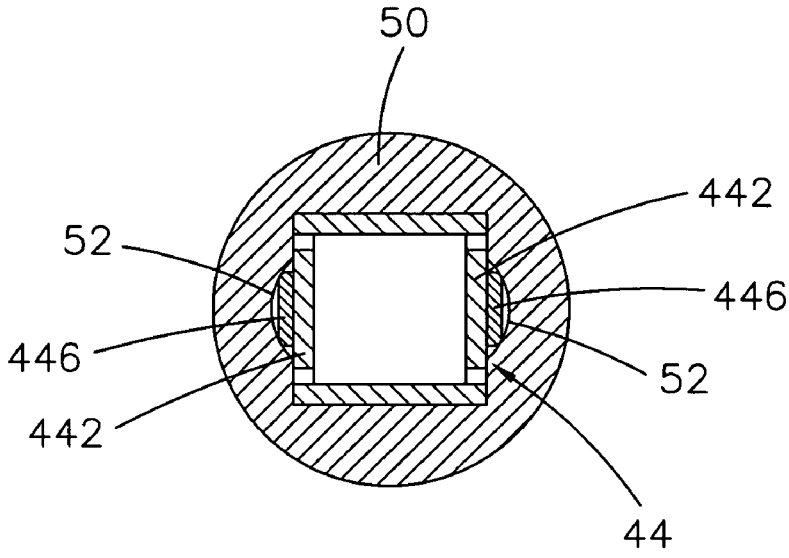
FIG. 8 is a cross-sectional view of the hanging device shown in FIG. 3.

Referring to FIG. 8, the resilient tabs 442 are not abutted against the key 37, so that they can be pivoted towards each other. When a pulling force is exerted on the tool 50, the bosses 446 can be moved from the recesses 52 so that the tool 50 can be moved from the joint 44.

Figure 9:
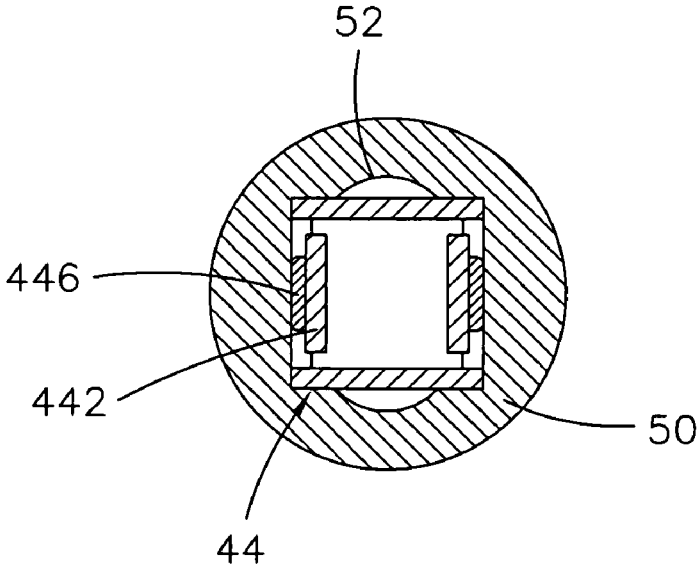
FIG. 9 is similar to FIG. 8 but shows the hanging device in a different position.

Referring to FIG. 9, alternatively, when a torque is exerted on the tool 50, the bosses 446 can be moved from the recesses 52 so that the tool 50 can be moved from the joint 44.

The present invention has been described through the detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A hanging device for hanging a tool, the hanging device comprising:

a hanger (10);

a stationary connector (20) formed at an end of the hanger (10) and with a plurality of hooks (24);

a rotational connector (30) comprising an annular groove (32) in an internal side thereof for receiving the hooks (24) so that the rotational connector (30) can be rotated relative to the stationary connector (20) and that the rotational connector (30) cannot be removed from the stationary connector (20), a plurality of blocks (36) on the external side, a key (37) formed at an end, and two hooks (38) extended from the key (37); and a tool-connecting element (40) comprising:

a head (42) comprising a leftover portion (422) formed with a stop (428) on the internal side for engagement with the hooks (38), a dispensable portion (424), and a plurality of ribs (426) formed between the leftover portion (422) and the dispensable portion (424); and a joint (44) comprising two resilient tabs (442) between and against which the key (37) is put, each of the resilient tabs (442) comprising a boss (446) for being inserted in two recesses (52) defined in the internal side of the tool (50) before the key (37) is put between and against the resilient tabs (442), wherein the ribs (426) can be cut in order to separate the dispensable portion (424) from the leftover portion (422) so that the tool (50) can be removed from the joint (44).

2. The hanging device according to claim 1 wherein the stationary connector (20) comprises at least one tooth (28) on the external side, wherein the rotational connector (30) comprises a plurality of teeth (34) on the internal side for engagement with the tooth (28) of the stationary connector (20).

3. The hanging device according to claim 1 wherein the width of the key (37) is marginally larger than the distance between the resilient tabs (442).

* * * * *